US005409047A

United States Patent [19]

Jorgensen

[11] Patent Number: 5,409,047

[45] Date of Patent: Apr. 25, 1995

[54] CHIPPER KNIFE

[76] Inventor: Ray B. Jorgensen, 18562 Wallingford Ave., N., Seattle, Wash. 98133

[21] Appl. No.: 58,866

[22] Filed: May 10, 1993

[51] Int. Cl.[6] ..... B27C 1/00; B27G 13/00

[52] U.S. Cl. ..... 144/176; 144/162 R; 144/218; 144/241; 241/291

[58] Field of Search ..... 144/162 R, 172, 174, 144/176, 212, 218, 230, 241; 241/291

[56] References Cited

U.S. PATENT DOCUMENTS

| | | | |
|---|---|---|---|
| 275,890 | 4/1883 | Cross | 144/241 |
| 293,135 | 2/1884 | Benjamin | 144/241 |
| 507,713 | 10/1893 | Mark | 144/212 |
| 3,559,705 | 2/1971 | Salzmann . | |
| 4,047,670 | 9/1977 | Svensson . | |
| 4,155,384 | 5/1979 | Svensson | 144/176 |
| 4,351,487 | 9/1982 | Haller et al. . | |
| 4,423,758 | 1/1984 | Haller et al. . | |
| 4,503,893 | 3/1985 | Demopoulos . | |
| 4,771,718 | 9/1988 | Carpenter et al. . | |
| 4,784,337 | 11/1988 | Nettles et al. . | |

*Primary Examiner*—W. Donald Bray
*Attorney, Agent, or Firm*—Robert W. Beach

[57] ABSTRACT

A chipper apparatus including a rotating disc with one or more knife assemblies mounted on the disc operable to produce wood chips under the cutting action of the knives. Each knife comprises an elongate knife body bounded by opposed cutting edges. The cutting edge further includes a contact surface for breaking apart and deflecting chips. The knife assembly includes interlocking keys for adjustable positioning of the knife in relation to a counter knife having multiple key recesses. The adjustable positioning of the knife permits the complete resharpening of the knife cutting edges.

13 Claims, 2 Drawing Sheets

Fig. 1.
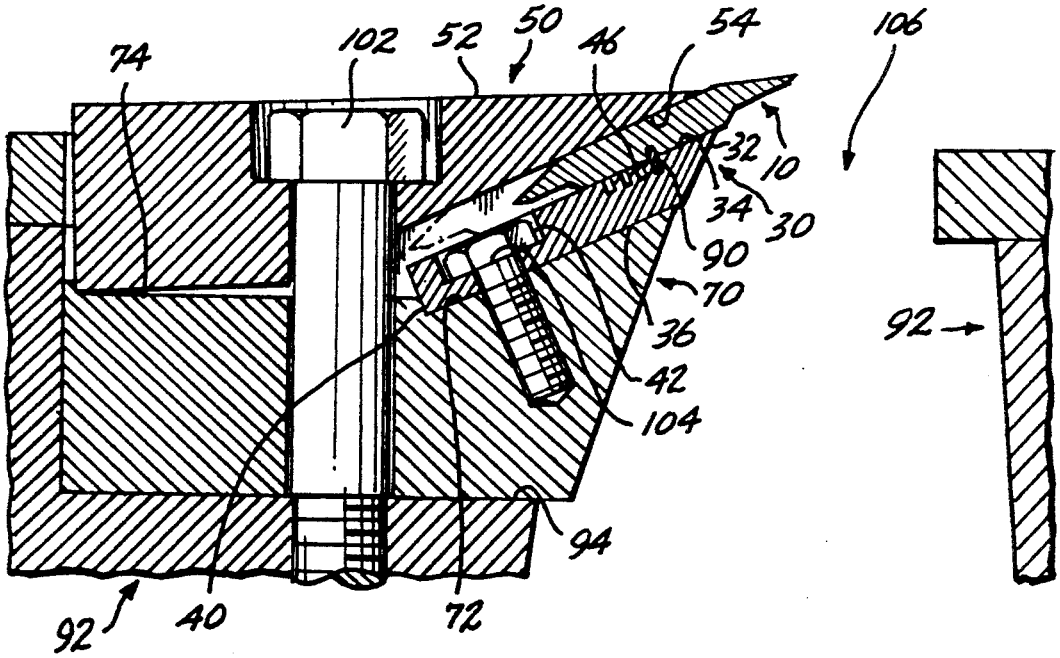
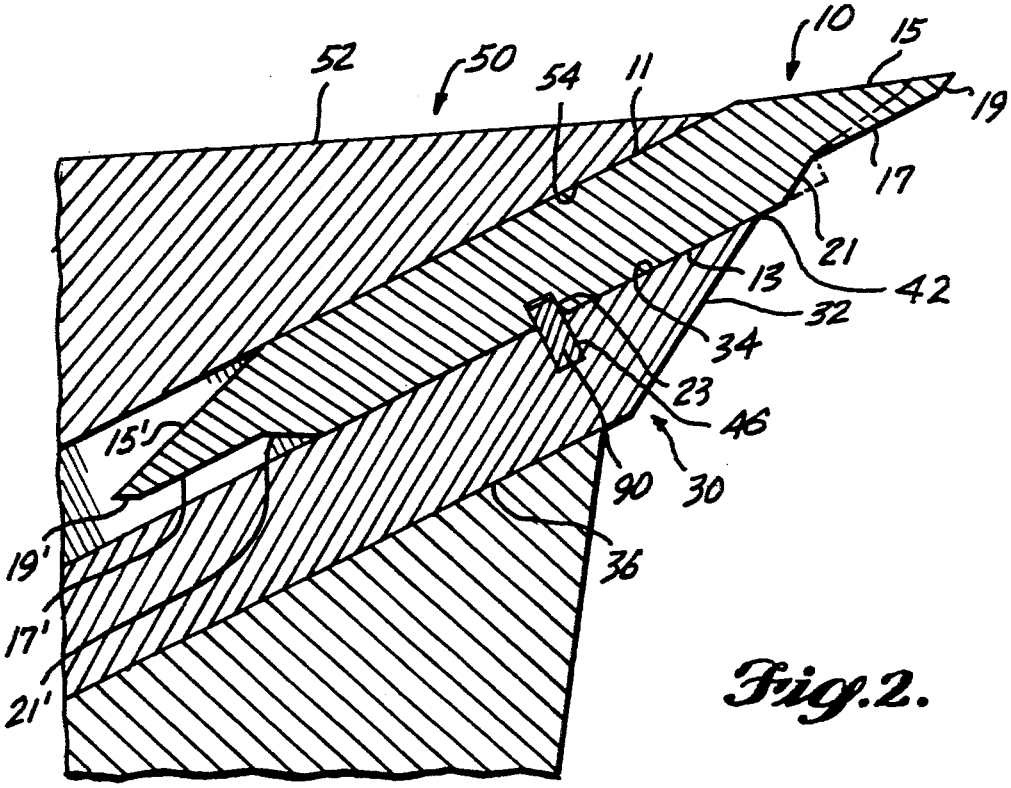
Fig. 2.

CHIPPER KNIFE

BACKGROUND OF THE INVENTION

1. Field of the Invention

This invention relates to a knife used in a wood chipper such as a rotatable disc type with a plurality of circumferentially spaced chip openings through the disc.

2. Prior Art

Wood chippers having rotatable cutters, or drums, or rotatable chipping discs with openings through which chips may pass, and fitted with double-edged knives are known in the art.

A single reshaping of the knife blade, involving the removal of material from one or both of the edge surfaces forming the cutting edges of a double-edged knife (known in the art as counter grinding), is often the only reshaping or resharpening of a knife blade before it is discarded.

One aspect of the geometry of knives is that knives having a large wedge angle, i.e., the angle between the two surfaces converging to the cutting edge, remain sharper longer and therefore are more popular. However, the larger wedge angles are more likely to cut a chip by shearing the chip from the incoming material rather than by cleavage. More force is required to sever chips by shearing than by cleavage, and thus more power is required for operation of a disc chipper having knives with larger wedge angles.

Another problem is the penetration of chip particles between the knife and the knife holding means beneath the knife, typically a counter knife, that can cause excessive pressure on the knife which may bend it.

SUMMARY OF THE INVENTION

The invention provides a novel knife for a chipper. The knife is double-edged, each cutting edge comprising an upper surface, preferably a standing bevel, and an under surface converging and intersecting to form a cutting edge. Additionally the knife includes a chip-deflecting surface forming the part of the under surface remote from the cutting edge which deflects and breaks chip material cut by the knife cutting edge.

This deflecting surface breaks chips and deflects them so as to prevent the penetration of chip particles between the knife and the knife holding means beneath the knife, such as a counter knife, and preferably so that the chips do not strike the knife holding means which decreases wear on the knife holding means.

BRIEF DESCRIPTION OF THE DRAWINGS

FIG. 1 is a cross section of a reusable knife and its associated holding means;

FIG. 2 is an enlarged cross section of a knife and its associated holding means;

DETAILED DESCRIPTION

Figure 3:
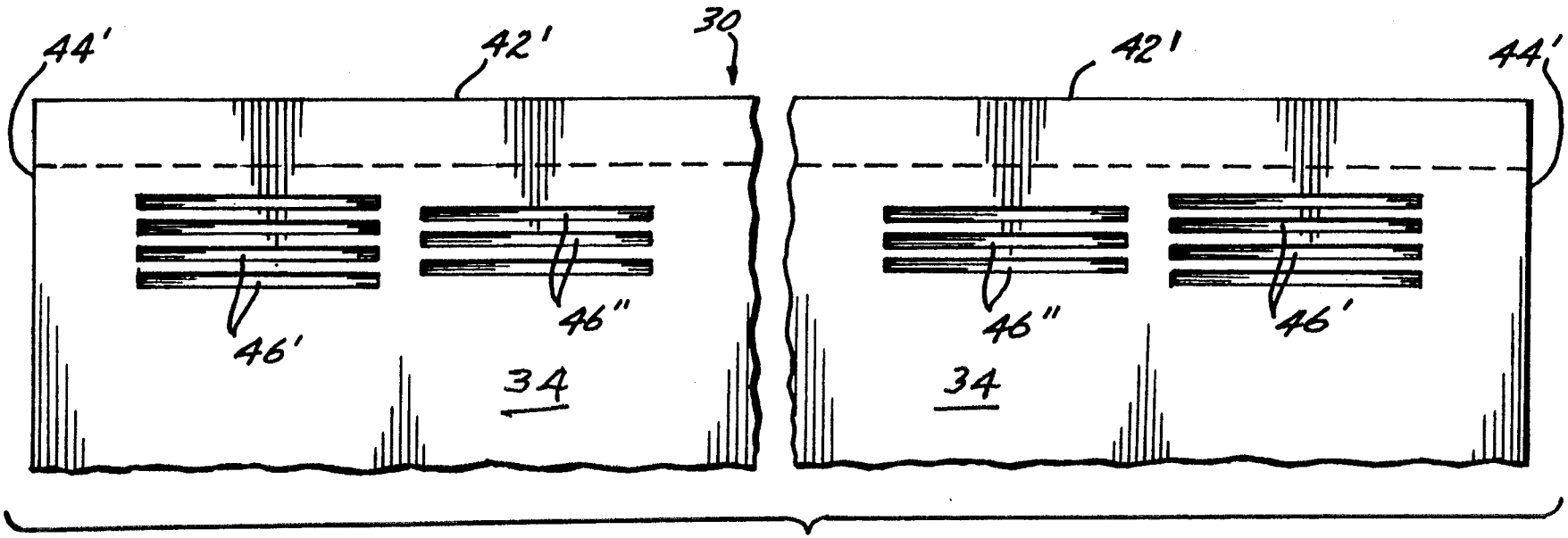
FIG. 3 is a partial top view of the counter knife used in the knife holding means of FIG. 1.

The knife of the present invention is illustrated as being used in a disc type wood or log chipper as shown in FIG. 1, but it could be used in a drum chipper or rotary knife chipper. The materials to be chipped, such as logs, are fed at an angle to the rotating disc. The chips pass through radially elongated openings 106 in the disc adjacent to the knives to be expelled from the chipper.

Each knife assembly includes a knife 10 or radial series of knives placed end to end, and knife holding means including knife seat 70, counter knife 30, and knife clamp 50. Each knife assembly is disposed in a disc recess 94 adjacent to a radially elongated opening 106 through the disc. The knife seat has an elongated body with a platform 72 thereon for placement of the counter knife 30, and a support 74 for the knife clamp 50. The platform 72 is threaded to receive a fastener such as a cap screw 104 for mounting the counter knife.

The counter knife has a bottom surface 36 in contact with the knife seat platform 72, a top surface 34 for engagement by the knife body 10, a recess 42 to receive the head of the mounting screw 104, and longitudinal recesses 46 for placement of interlocking means or key 90.

The grooves 46 in the top of the counter knife are preferably of rectangular cross section and are arranged in sets. Typically each outer set includes grooves 46' and each inner set includes grooves 46'' as shown in FIG. 3. The grooves 46' and 46'' of both sets are parallel to the edge of the counter knife underlying the knife and to the main longitudinal axis of the counter knife. The grooves 46'' of the inner set are staggered in relation to the grooves 46' of the outer set of grooves. The distance between adjacent grooves of each set can be very small, such as approximately $\frac{1}{8}$ of an inch on centers and the distance between the centers of the grooves in one set and the centers of the grooves in the other set transversely of the groove length will be 1/16 of an inch as shown in FIG. 3. The different sets of grooves 46' and 46'' represent different positions for the knife that is interlocked with the counter knife so as to permit position changes corresponding to small amounts of material, about 1/16 of an inch, to be removed from the knife cutting edges during resharpening.

After a knife edge has been resharpened, the knife will be assembled with the counter knife as shown in FIG. 1 and two keys 90 will be placed in corresponding grooves 46' of the outer set of grooves or in corresponding grooves 46'' of the inner set of grooves, depending upon the desired degree of projection of the knife edge beyond the counter knife edge as indicated in FIG. 1. Initially the keys will be placed in grooves 46' or 46'' farther from the edge of the counter knife, and the keys will be moved toward the counter knife edge progressively, first in grooves 46', then in grooves 46'', then back to grooves 46', until the knife edge has been resharpened as many times as possible. At that point, the keys 90 will be located in the grooves 46' closest to the edge of the counter knife 30 as shown in FIG. 1.

The dashed lines extending to the left of knife 10 in FIG. 1 represent the profile of a new knife prior to any use or regrinding. Subsequent regrinds make the knife narrower and narrower as both edges are resharpened until it is reduced to the knife 10 shown in solid lines in FIG. 1. Once the edges of the knife shown in solid lines in FIG. 1 are completely dulled, the knife is discarded.

The double-edged knife 10 comprises an elongated body having cutting edges on its opposite edges. The body of the knife has a top surface 11 and a bottom surface 13 as shown in FIG. 2. Each cutting edge has an upper surface 15, preferably a standing bevel at an obtuse angle to the top surface 11, which projects beyond and preferably is inclined slightly relative to the plane of the disc. Each cutting edge additionally has an under surface 17, which may be an under bevel. The intersection of the convergent upper and under surfaces forms the cutting edge of the knife and the included angle between the upper surface and the under surface defines the wedge angle of the knife.

The knife further includes a chip-deflecting surface 21 between the under surface 17 and the bottom surface 13 of the knife which terminates in a heel remote from the cutting edge of the knife. Such chip-deflecting surface 21 merges with the under surface 17 of the knife so as to form a depression which may be a reentrant angle as shown in FIG. 2. The inclination of the under surface or under bevel 17 in relation to the bottom surface 13 may vary from 0 degrees to 20 degrees, making the included angle from 180 degrees to 160 degrees, and the inclination of the chip-deflecting surface 21 to the bottom surface 13 may vary from 20 degrees to 90 degrees, so that the included angle would be 160 degrees to 90 degrees as shown in FIG. 2, but should always be greater than the angle between the under surface or under bevel 17 and the bottom surface 13 so that the surface 17 will be offset from the bottom surface 13 of the knife. The depth of the depression between the cutting edge and the heel of the chip-deflecting surface 21 is approximately one-fifth to one-third of the thickness of the knife between the heel of the chip-deflecting surface and the upper surface 15.

The purpose of the chip-deflecting surface 21 is to break apart chips cut by the cutting edge of the knife and to deflect the chips toward the discharge slot 106 and away from the end surface 32 of the knife holding means or counter knife beneath the knife so as to prevent chip material from wedging into the joint between the knife and the counter knife beneath the knife. The knife holding means are set back from the chip-deflecting surface 21 so as to minimize the chip material striking the knife holding means.

Additionally, the knife can include a fourth surface 19 between the upper surface 15 and the under surface 17 to increase the wedge angle of the knife locally at the apex of the cutting edge.

The knife is held in position by the knife clamp 50 as shown in FIG. 1. The knife clamp has a knife engagement surface 54 contacting the knife top surface 11. The knife clamp is secured by a fastener such as a screw 102.

Following resharpening of the knife, the interlocking means or keys would be repositioned in the grooves of the counter knife shown in FIGS. 1 and 3 to advance the now narrower knife by moving the knife laterally relative to its longitudinal axis and cutting edge. This process could be repeated each time the knife cutting edges are resharpened. A plurality of grooves in the counter knife as shown in FIG. 3 permit this process to be repeated as many times as there are grooves in a set 46' and in a set 46''.

The degree of inclination of the chip-deflecting surface 21 could be altered during resharpening of the cutting edge and thus affect the breaking force and chip deflection provided by contact of the chips with such surface. The setback of the heel of the chip-deflecting surface from the cutting edge could also be altered independently of the degree of narrowing of the knife effected by sharpening of the cutting edge.

What is claimed is:

1. In a chipper knife having a cutting edge formed by the intersection of an upper surface and an under surface and having a bottom, the improvement comprising a chip-deflecting surface extending between the under surface and the bottom of the knife and forming a depression with the under surface for breaking chips and deflecting them prior to passing beyond the bottom surface of the knife.

2. In the chipper knife defined in claim 1, the under surface being an under bevel.

3. In the chipper knife defined in claim 1, the chip-deflecting surface of the knife forming an included angle with the bottom of the knife which is smaller than the included angle between the under surface of the knife and the bottom of the knife.

4. In the chipper knife defined in claim 3, the included angle between the chip-deflecting surface and the bottom of the knife being within the range of 160 degrees to 90 degrees.

5. In the chipper knife defined in claim 4, the included angle between the chip-deflecting surface and the bottom of the knife being approximately 150 degrees.

6. In the chipper knife defined in claim 1, the depression formed by the under surface and the chip-deflecting surface including a reentrant angle.

7. In the chipper knife defined in claim 1, the depression formed by the under surface and the chip-deflecting surface having a depth approximately one-fifth to one-third of the thickness of the knife between the upper surface and the end of the chip-deflecting surface remote from the cutting edge.

8. In the chipper knife defined in claim 1, knife holding means beneath the chipper knife set back from the chip-deflecting surface to minimize chips deflected by the chip-deflecting surface striking such knife holding means.

9. In the chipper knife defined in claim 1, the chipper knife bottom having a groove extending parallel to the cutting edge, knife holding means beneath the chipper knife having a top with a groove parallel to said groove in the chipper knife, and a key fitting in said chipper knife groove and said knife holding means groove for securing the chipper knife in predetermined relationship to said knife holding means.

10. In the chipper knife and knife holding means defined in claim 9, the knife holding means top having a plurality of parallel grooves for receiving the key.

11. In the chipper knife and knife holding means defined in claim 10, the top of the knife holding means having two sets of parallel grooves arranged in staggered relationship so that the grooves of one set are offset transversely of the their lengths relative to the grooves in the other set.

12. In a chipper knife having a cutting edge formed by the intersection of an upper surface and an under surface, and the knife having a bottom, in combination with knife holding means beneath the knife and having a top, the improvement comprising the chipper knife having in its bottom a groove extending parallel to its cutting edge, the knife holding means having in its top a groove parallel to said chipper knife groove, and a key fitting in said chipper knife groove and said knife holding means groove for securing the chipper knife to the knife holding means against movement of the chipper knife relative to the knife holding means in a direction transversely of said grooves.

13. In the chipper knife and knife holding means combination defined in claim 12, the top of the knife holding means having in it two sets of grooves offset lengthwise of said grooves in said groove sets, and the grooves in said two sets being staggered transversely of their length.

* * * * *